US006031323A

United States Patent [19]

Behr et al.

[11] Patent Number: 6,031,323

[45] Date of Patent: Feb. 29, 2000

[54] ELECTRIC LAMP WITH MECHANICAL CONNECTION

[75] Inventors: Gerhard Behr, Altheim; Peter Helbig, Sontheim; Hermann Steiner, Herbrechtingen; Christian Wittig, Munich, all of Germany

[73] Assignee: Patent-Treuhand-Gesellschaft fuer elektrische Gluehlampen mbH, Munich, Germany

[21] Appl. No.: 08/781,070

[22] Filed: Feb. 9, 1997

[30] Foreign Application Priority Data

Jan. 25, 1996 [DE] Germany ..... 196 02 625

[51] Int. Cl.[7] ..... H01J 5/48

[52] U.S. Cl. ..... 313/318.01; 313/318.05; 313/318.09; 313/318.1

[58] Field of Search ..... 313/318.01, 318.02, 313/318.03, 318.04, 318.05, 318.06, 318.09, 318.11, 318.12, 318.1; 439/352, 353, 355

[56] References Cited

U.S. PATENT DOCUMENTS

| | | | |
|---|---|---|---|
| 4,495,874 | 1/1985 | Sanders et al. | 313/318.09 |
| 4,795,939 | 1/1989 | Eckhardt . | |
| 5,250,874 | 10/1993 | Hall et al. | 313/318.01 |
| 5,428,261 | 6/1995 | Wittig et al. | 313/318.1 |

FOREIGN PATENT DOCUMENTS

| | | |
|---|---|---|
| 0 231 936 | 8/1987 | European Pat. Off. . |
| 0 235 855 | 9/1987 | European Pat. Off. . |
| 0 301 564 | 2/1989 | European Pat. Off. . |
| 0 310 792 | 4/1989 | European Pat. Off. . |
| 0 331 042 | 9/1989 | European Pat. Off. . |
| 0 384 240 | 8/1990 | European Pat. Off. . |
| 0 553 250 A1 | 3/1993 | European Pat. Off. . |
| 0 580 013 A1 | 1/1994 | European Pat. Off. . |
| 0 618 609 A1 | 10/1994 | European Pat. Off. . |
| 2 507 012 | 12/1982 | France . |

*Primary Examiner*—Nimeshkumar D. Patel
*Assistant Examiner*—Joseph Williams
*Attorney, Agent, or Firm*—William E. Meyer

[57] ABSTRACT

The invention concerns an electric lamp, particularly a high-pressure discharge lamp or halogen bulb with a base on one side for a motor-vehicle headlight. The base of the lamp of the invention has a base sleeve (110) comprised of an electrically insulating material and a mounting element (111) also comprised of an electrically insulating material, which bears lamp bulb (116) and which is joined with base sleeve (110). According to the invention, a metal part (121) is anchored in mounting element (111) and a metal ring (122) is anchored in base sleeve (110), whereby metal ring (122) is equipped with several shaped spring-type weld lugs (122), which are welded with metal part (121) anchored in mounting element (111).

12 Claims, 3 Drawing Sheets

ELECTRIC LAMP WITH MECHANICAL CONNECTION

1. Technical Field

The invention relates to electric lamps and particularly to electric lamps for motor vehicles. More particularly the invention is concerned with an electric lamp with a mechanical connection useful in motor vehicles.

2. Background Art

A vehicle lamp with a mechanical connection is disclosed, for example, in European Patent EP 0 231,936. This document describes an electric lamp, especially a halogen bulb, which has a base on one side and can be used in a motor-vehicle headlight. The lamp has a lamp bulb with current leads guided out from the lamp bulb, a mounting element that attaches the lamp bulb, and a base sleeve comprised of plastic. The mounting element and the base sleeve are joined together by means of high-frequency heating. The mounting element is comprised of plastic, at least in the region where it is joined with the base sleeve. In addition, a piece of ferromagnetic material is arranged in this joining region, and this piece is heated inductively in order join the base sleeve and the mounting element.

A high-pressure discharge lamp, which has a base on one side and a mounting element that bears the discharge vessel, is comprised of plastic, and is fastened in turn in a base sleeve comprised of plastic, is disclosed in European Patent Application EP-A 0 580,013. The mounting element has an annular peripheral groove in the region where it is joined with the base sleeve, and a piece of ferromagnetic material, which will be inductively heated for fusing the base sleeve and the mounting element, is arranged in this groove.

DISCLOSURE OF THE INVENTION

The electric lamp of the invention is equipped with a base, which has a base sleeve and a mounting element for the lamp bulb. Both the mounting element for the lamp bulb and the base sleeve are comprised of an electrically insulating material. In this way, the base has a particularly high high-voltage resistence, as is required for high-pressure discharge lamps for application in motor-vehicle headlights. According to the invention, a metal piece is anchored into the mounting element. In addition, a metal ring or a metal ring segment, which is equipped with shaped, spring-type weld lugs that are welded with the metal part attached to the mounting element, is anchored in the base sleeve. This type of joint between the base sleeve and the mounting element cools more rapidly than the high-frequency-induced bonding of base sleeve and mounting element according to the above-cited state of the art. In this way, the welding of mounting element and base element according to the invention permits a higher adjustment performance on production lines and makes possible a more cost-favorable lamp manufacture.

Advantageously, the mounting element is arranged in a take-up part of the base sleeve, preferably inside the base sleeve, in such a way that the lamp base has a comparably low structural height. The base sleeve and the mounting element advantageously each comprise a plastic injection-molded part, into which the metal ring/metal ring segment provided with the shaped weld lugs and the metal part attached in the mounting element are injected. The metal part anchored in the mounting element is advantageously shaped as a ring surrounding the mounting element, while the metal ring provided with the weld lugs or the metal ring segment provided with the weld lugs is embedded in the side wall of the base sleeve that bounds the part taking up the mounting element in such a way that the weld lugs are applied in spring-like manner to the annular metal part of the mounting element prior to welding. In this way, the mounting element and the base sleeve can be adjusted once more prior to welding.

The joining of the base sleeve and the mounting element bearing the lamp bulb according to the invention, however, may also be applied advantageously in high-pressure discharge lamps, which have a base on one side and which are provided for application in motor-vehicle headlights. The lamp bulb of the high-pressure discharge lamp with a base on one side is thus either the discharge vessel of the high-pressure discharge lamp or an outer bulb that wholly or partially surrounds the discharge vessel.

The joining of the base sleeve and the mounting element that bears the lamp bulb according to the invention, however, may also be used advantageously in halogen bulbs, which have a base on one side and which are provided for application in motor-vehicle headlights.

The invention will be explained in more detail in the following on the basis of two preferred examples of embodiment.

BEST MODE FOR CARRYING OUT THE INVENTION

Figure 1:
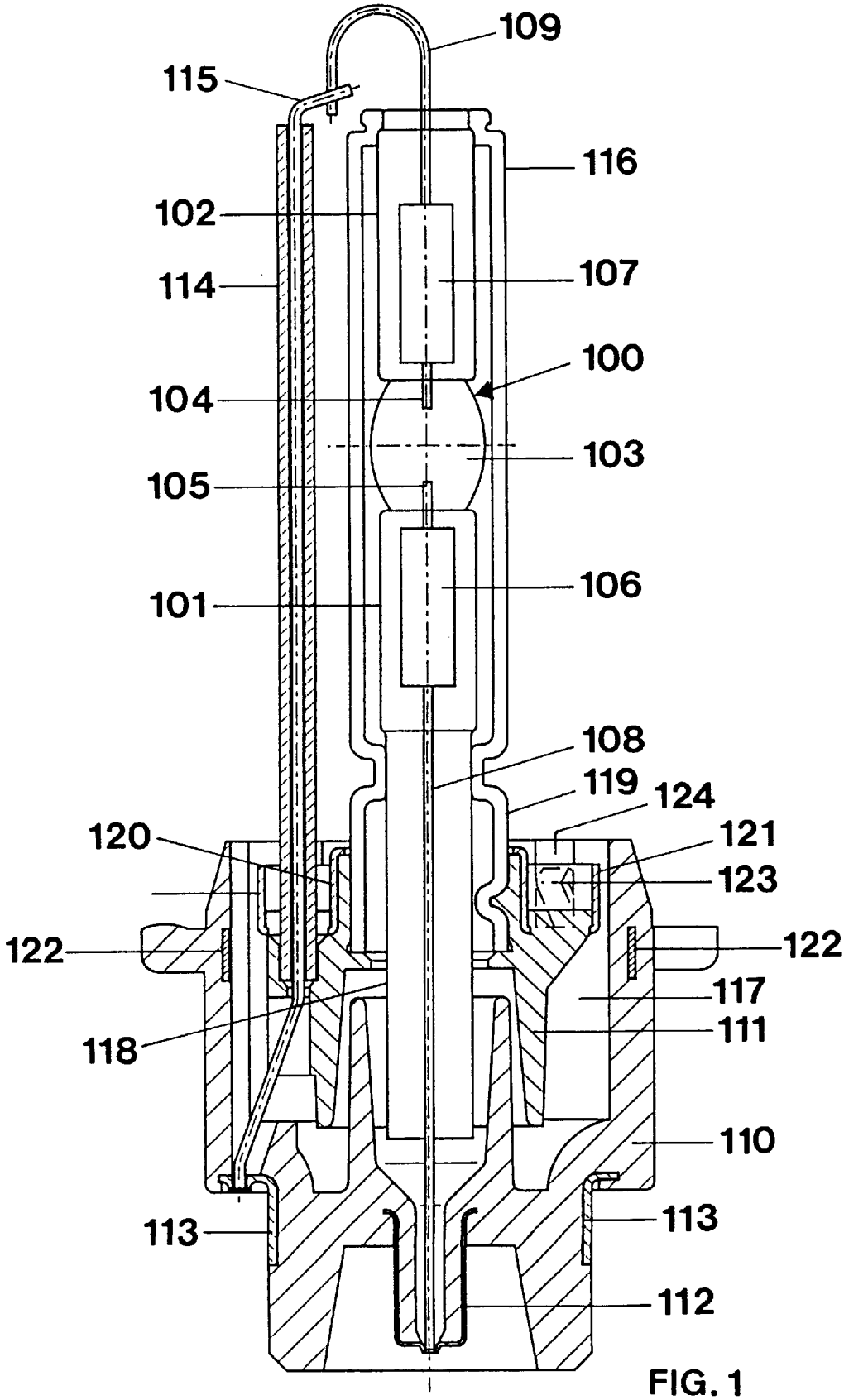
FIG. 1 shows a side view of a high-pressure discharge lamp with a base on one side according to the first example of embodiment of the invention in a partially cutaway representation.

The first example of embodiment, which is illustrated in FIG. 1, involves a high-pressure discharge lamp, which has a base on one side and which is provided for use in a motor-vehicle headlight. This lamp has a double-ended tubular-type discharge vessel 100 with a gas-tight closed discharge space 103, a pinch end 101 next to the base and a pinch end 102 remote from the base. Two electrodes 104, 105, each of which is connected in an electrically conducting manner with a current lead 108, 109 guided out from pinch ends 101, 102, by means of a molybdenum foil 106, 107 sealed in a gas-tight manner, project into discharge space 103. The lamp base has a base sleeve 110 comprising a plastic injection-molded part and a mounting element 111 also comprised of a plastic injection-molded part, which is adjustable, and which is arranged within base sleeve 110. The end of base sleeve 110 turned away from discharge vessel 100 is configured as a connector with two electrical contacts 112, 113. The central contact 112 is connected in an electrically conducting manner with the current lead 108 guided out from pinch end 101 near the base, whereas the other annular electrical contact 113 is connected in an electrically conducting manner with current lead 109 projecting out from pinch end 102 remote from the base by means of a return lead 115 ensheathed by a ceramic tube 114.

Discharge vessel 100 is surrounded by a cylindrical outer bulb 116 arranged nearly coaxial to discharge vessel 100, and this bulb is fused to pinch end 102 remote from the base and to a tube-shaped projection 118 of discharge vessel 100 that extends in base sleeve 110. Outer bulb 116 is equipped with a tube-shaped extension 119, which partially surrounds the tube-shaped projection 118 of discharge vessel 100. For mounting the base of the high-pressure discharge lamp, tube-shaped extension 119 of outer bulb 116 is sealed in mounting element 111 by means of a metal perforated collar integrated into mounting element 111 and surrounding the tube-shaped extension 119 of outer bulb 116, and this metal collar is heated with a high-frequency induction signal.

Base sleeve 110 is shaped like a pot. Mounting element 111 is completely arranged on the interior 117 of base sleeve 110. The outer wall of mounting element 111 is formed partly by an annular metal part 121, which surrounds mounting element 111 and is anchored in mounting element 111. A metal ring 122, which has four weld lugs 123, is embedded in the side wall of the pot-type base sleeve 110. These four weld lugs 123 project into the interior 117 of base sleeve 110 and are applied in spring-type manner to annular metal part 121 of mounting envelope 111 when inserting mounting element 111 into base sleeve 110 and during the subsequent adjustment of the lamp. After terminating the adjustment, weld lugs 123 are welded with annular metal part 121 and in this way mounting element 111 and base sleeve 110 are joined together in the adjusted position. Thus weld lugs 123 are accessible for welding tools, since the wall of base sleeve 110 has an opening 124 in the region of each of weld lugs 123.

FIG. 1 shows one of the four weld lugs 123 with broken lines, since this is concealed normally by the annular metal part 121 in the view selected here. The annular metal part 121 and the metal perforated collar 120 bound an annular groove 124 in mounting element 111, in which a conductor loop (not shown) is introduced for a short time for the purpose of high-frequency-induced heating of metal perforated collar 120.

Figure 2:
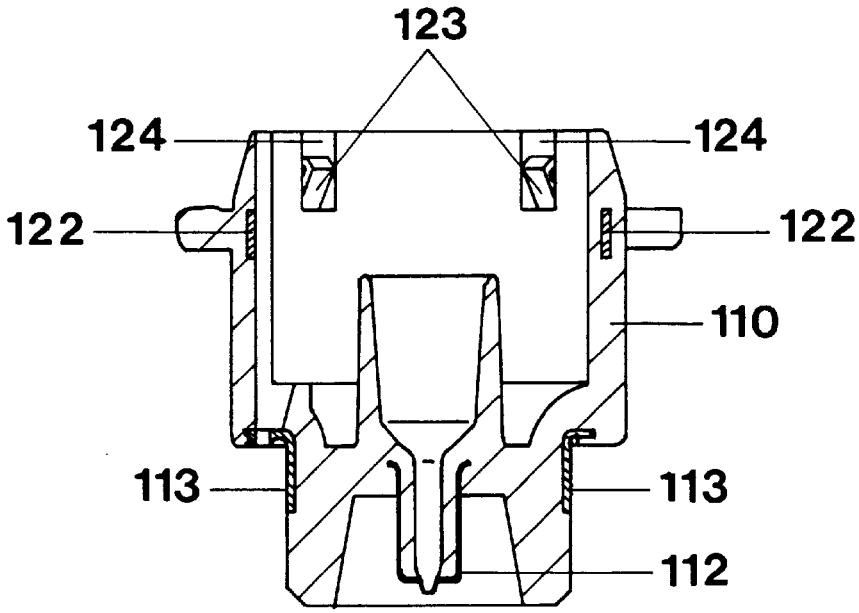
FIG. 2 shows a longitudinal view through the base sleeve of the lamp illustrated in FIG. 1, with the metal ring injected therein and provided with shaped weld lugs.

FIG. 2 shows a longitudinal section through base sleeve 110 embodied as a plastic injection-molded part with the metal ring 122 injected therein and two weld lugs 123 shaped on metal ring 122. Weld lugs 123 are post-shaped after injecting metal ring 122 in base sleeve 110, so that they are bent out from metal ring 122 and project to the interior 117 of base sleeve 110. The side wall of pot-type base sleeve 110 has an opening 124 in the region of each weld lug 123.

Figure 3:
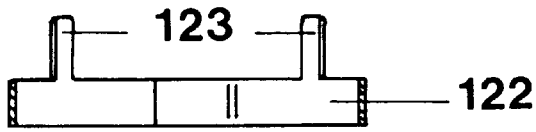
FIG. 3 shows a side view of the metal ring with shaped weld lugs (incompletely formed), which ring is anchored in the base sleeve according to FIGS. 1 and 2.
Figure 4:
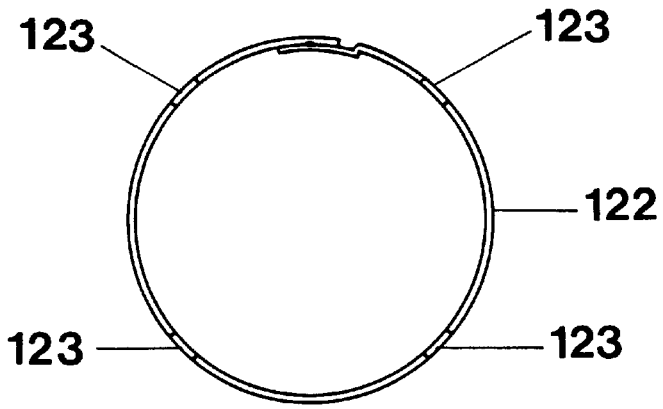
FIG. 4 shows a top view onto the metal ring according to FIG. 3.

FIGS. 3 and 4 show details of metal ring 122 provided with shaped weld lugs 123 prior to the post-shaping process for weld lugs 123. Metal ring 122 provided with weld lugs 123 is manufactured from a spring steel strip, which was bent into a ring and welded.

Figure 5:
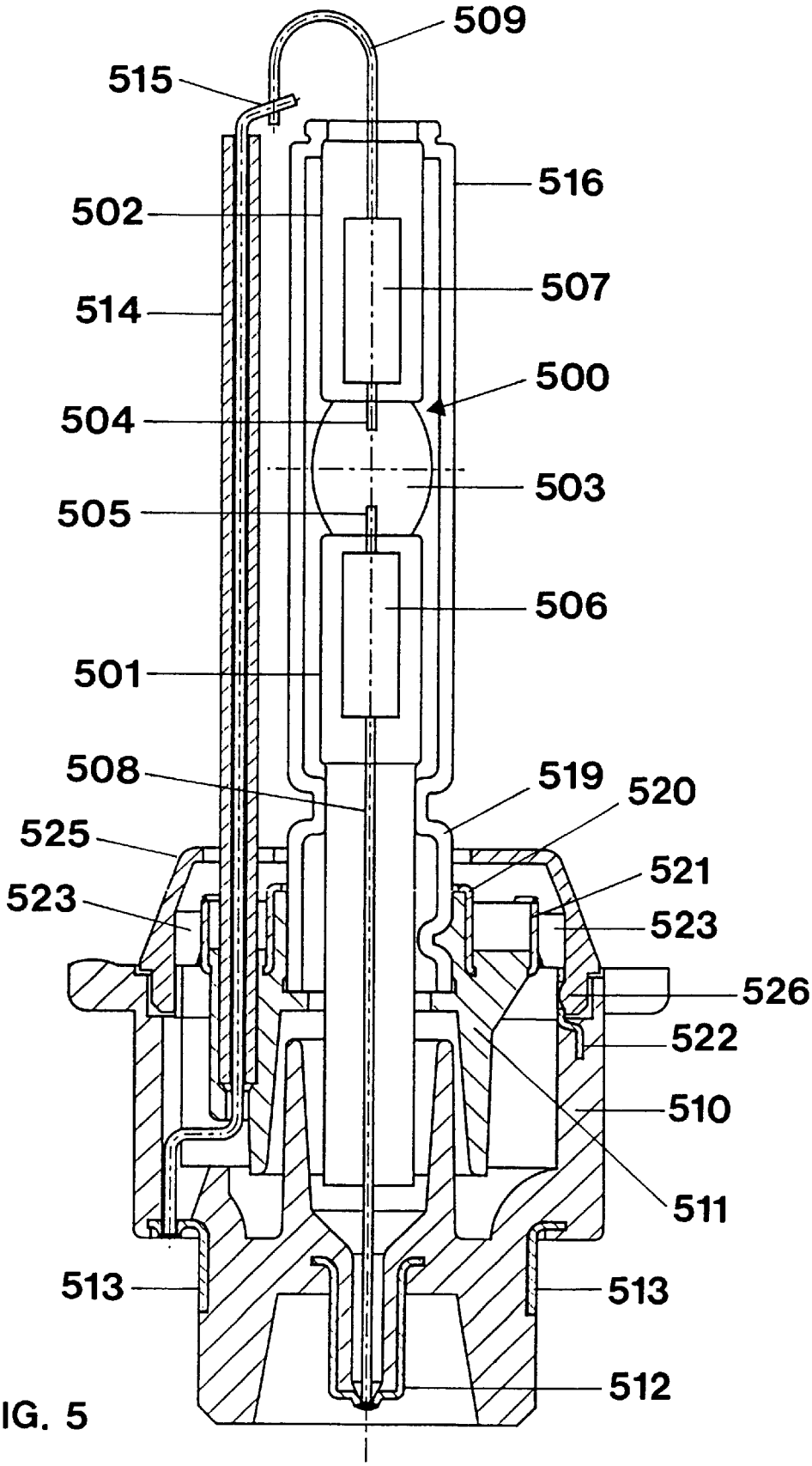
FIG. 5 shows a side view of a high-pressure discharge lamp with a base on one side according to the second example of embodiment of the invention in partial cutaway representation.

FIG. 5 shows a second example of embodiment of the invention, which is distinguished from the first example of embodiment essentially only by the base sleeve.

The second example of embodiment, which is illustrated in FIG. 5, also involves a high-pressure discharge lamp, which has a base on one side and which is provided for use in a motor-vehicle headlight. This lamp has a double-ended tubular-type discharge vessel 500 with a gas-tight closed discharge space 503, a pinch end 501 next to the base and a pinch end 502 remote from the base. Two electrodes 504, 505, each of which are connected in an electrically conducting manner with a current lead 508, 509 guided out from pinch ends 501, 502 by means of a molybdenum foil 506, 507 sealed in a gas-tight manner in pinch end 501 or 502, project into discharge space 503. The lamp base has a base sleeve 510 comprised of a plastic injection-molded part and a mounting element 511 also comprised of a plastic injection-molded part, which is adjustable and arranged partially inside base sleeve 510. The end of base sleeve 510 turned away from discharge vessel 500 is configured as a connector with two electrical contacts 512, 513. The middle contact 512 is connected in an electrically conducting manner with current lead 508 guided out from pinch end 501 near the base, whereas the other annular electrical contact 513 is connected in an electrically conducting manner with current lead 509 guided out from pinch end 502 remote from the base by means of a back-guide 515 ensheathed by a ceramic tube 514.

Discharge vessel 500 is surrounded by a cylindrical outer bulb 516 arranged nearly coaxial to discharge vessel 500 and this bulb is sealed with pinch end 502 remote from the base and to a tube-shaped projection 518 of discharge vessel 500 extending into base sleeve 510. Outer bulb 516 is equipped with a tube-shaped extension 519, which partially surrounds the tube-shaped projection 518 of discharge vessel 500. For mounting the base of the high-pressure discharge lamp, tube-shaped extension 519 of outer bulb 516 is sealed into mounting element 511 by means of a metal perforated collar 520 that surrounds tube-shaped extension 519 of outer bulb 516 and is integrated in mounting element 511, and this collar is heated with a high-frequency induction signal.

Base sleeve 510 is shaped like a pot. Mounting element 511 is found in a take-up part 517 inside base sleeve 510. The outer wall of mounting element 511 is partially formed by an annular metal part 521, which surrounds mounting element 511 and which is anchored in mounting element 511. The region of mounting element 511 surrounded by annular metal part 521 projects out from the pot-type base sleeve 510. A metal ring 522, which has two shaped weld lugs 523 formed like a clamp, is embedded in the side wall of pot-type base sleeve 510. These two weld lugs 523 are applied in spring-type manner to annular metal part 521 of mounting element 511 when mounting element 511 is inserted into base sleeve 510 and during the subsequent adjustment of the lamp. After the adjustment has been terminated, the ends of clamp-type weld lugs 523 are welded with annular metal part 521 and in this way mounting element 511 and base sleeve 510 are joined together in the adjusted position. The part of mounting element 511 projecting out from base sleeve 510 and weld lugs 523 are covered by means of a shrouding cover 525, which is joined with base sleeve 510 by means of a snap closing 526. Shrouding cover 525 has two lead-ins for outer bulb 516 and for back-guide 515 provided with ceramic sheath 514.

The invention is not limited to the examples of embodiment that are described in more detail above. The welding of the mounting element and base sleeve according to the invention can also be applied to a halogen bulb with a base on one side. In addition, the mounting element and the base sleeve need not absolutely be comprised of plastic. For example, one of the base parts or even both of the above-mentioned base parts may comprise Micaver or an electrically insulating ceramic material.

What is claimed is:

1. An electric lamp comprising: a base and a lamp bulb, the base having a base sleeve (110; 510) defining an interior cavity and comprised of an electrically insulating material and anchored in the base sleeve (110; 510) and facing the interior cavity is at least a segment of a metal ring (122; 522)

equipped with at least two extending spring-type weld lugs (123; 523), the base further having a mounting element (111; 511) comprised of an electrically insulating material, and anchored in the mounting element (111; 511) is a metal part (121; 521), the mounting element (111; 511) being located in the interior cavity with the extending spring-type weld lugs (123; 523), being solidly fixed to the metal part (121; 521), and the lamp bulb (116; 516) being attached in the mounting element (111; 511).

2. Electric lamp according to claim 1, further characterized in that base sleeve (110; 510) has a take-up part (117; 517) for mounting element (111; 511), into which mounting element (111; 511) is inserted.

3. Electric lamp according to claim 1, further characterized in that metal ring (122; 522) or the metal ring segment is anchored in the wall or walls of base sleeve (110; 510), which bound take-up part (117; 517).

4. Electric lamp according to claim 1, further characterized in that weld lugs (123; 523) shaped on metal ring (122; 522) or the metal ring segment project from the side wall or walls of base sleeve (110; 510).

5. Electric lamp according to claim 1, further characterized in that metal part (121; 521) is a metal ring, which surrounds mounting element (111; 511).

6. Electric lamp according to claim 2, further characterized in that mounting element (111) is arranged inside base sleeve (110) and weld lugs (123) project to the interior (117) of base sleeve (110).

7. Electric lamp according to claim 1, further characterized in that base sleeve (110; 510) is a plastic injection-molded part.

8. Electric lamp according to claim 1, further characterized in that mounting element (111; 511) is a plastic injection-molded part.

9. Electric lamp according to claim 1, further characterized in that the lamp is a high-pressure discharge lamp with a base on one side.

10. Electric lamp according to claim 9, further characterized in that the lamp bulb is the discharge vessel of the high-pressure discharge lamp.

11. Electric lamp according to claim 9, further characterized in that the high-pressure discharge lamp has an outer bulb (116; 516) partially or completely surrounding discharge vessel (100; 500) and the lamp bulb is outer bulb (116; 516) of the high-pressure discharge lamp.

12. Electric lamp according to claim 1, further characterized in that the lamp is a halogen bulb with a base on one side.

* * * * *